US006033252A

United States Patent [19]

Hood et al.

[11] Patent Number: 6,033,252

[45] Date of Patent: Mar. 7, 2000

[54] COMPONENT RETAINING DEVICE

[75] Inventors: Brian M. Hood, Clinton Township; Brent Kuhn, Novi, both of Mich.

[73] Assignee: Lear Automotive Dearborn, Inc., Southfield, Mich.

[21] Appl. No.: 09/006,871

[22] Filed: Jan. 14, 1998

[51] Int. Cl.[7] ..... H01R 13/64

[52] U.S. Cl. ..... 439/374; 439/953

[58] Field of Search ..... 439/374, 358, 439/621, 622, 953, 489, 359

[56] References Cited

U.S. PATENT DOCUMENTS

| | | | |
|---|---|---|---|
| 5,145,414 | 9/1992 | Oikawa | 439/374 |
| 5,171,293 | 12/1992 | Umemoto et al. . | |
| 5,247,250 | 9/1993 | Rios . | |
| 5,277,626 | 1/1994 | Oikawa et al. | 439/621 |
| 5,580,281 | 12/1996 | Takeuchi | 439/621 |
| 5,680,088 | 10/1997 | Seki et al. | 439/621 |

FOREIGN PATENT DOCUMENTS

| | | |
|---|---|---|
| 2735280 | 12/1996 | France . |
| 4441281A1 | 5/1996 | Germany . |
| 2262667A | 6/1993 | United Kingdom . |
| 2279826A | 1/1995 | United Kingdom . |

*Primary Examiner*—Paula Bradley
*Assistant Examiner*—Katrina Davis
*Attorney, Agent, or Firm*—MacMillan, Sobanski & Todd, LLC

[57] ABSTRACT

A device for retaining an electrical component such as a fuse relative to a circuit includes a retainer body portion that receives and supports the electrical component. A cover maintains the component in position on the retainer body portion. A housing that surrounds the circuit includes a guide member that guides the retainer and maintains it in proper alignment with the housing. The retainer is moveable between a first position where the component engages a connection terminal in the circuit and a second position where the component is disconnected from the circuit. The retainer includes structure that maintains the component in the disconnected position until the retainer is specifically manipulated to allow the component to be reinserted into the connection terminal.

18 Claims, 2 Drawing Sheets

COMPONENT RETAINING DEVICE

BACKGROUND OF THE INVENTION

This invention generally relates to a device for retaining an electrical component in a preselected orientation relative to a circuit.

Modern vehicles include an increasingly large number of electrical and electronic components. While the introduction of these various components make vehicles more efficient and introduce the possibility for a more versatile driving experience, they introduce the problem of providing sufficient electrical connections throughout the vehicle. One aspect of the challenge to provide sufficient wiring in a vehicle is arranging the circuitry. Another is handling components such as fuses that are selectively inserted into and removed from connection with the circuitry. Complex assembly and repair operations can require handling many components such as fuses and often becomes cumbersome.

This invention provides a component retainer device that maintains the component in a selected orientation relative to the circuitry. More specifically, this invention provides a retainer that holds a fuse in a position where it is aligned with a circuit connection even though it is disconnected from the circuitry. This invention prevents the loss and mishandling of fuses especially in complex arrangements such as in an automotive vehicle.

SUMMARY OF THE INVENTION

In general terms, this invention is a device for positioning a component such as a fuse relative to a circuit. A device designed according to this invention holds a component in a selected orientation and position relative to the circuitry so that the component is easily and accurately inserted into an electrical connection terminal and disconnected without getting lost.

This invention includes several basic parts. A housing is adapted to house at least a portion of the circuit including a terminal connection for connecting a component such as a fuse to the circuit. A component receiver is adapted to receive and support the component. The component receiver is movably supported on a guide member that is, in turn, supported on the housing. The guide member guides the component receiver so that it can be moved between a first position where the component engages the connection terminal and a second position where the component is spaced from the connection terminal. The component receiver includes structure that maintains the component in the second position so that the component is disconnected from the electrical connection terminal and not removable from the housing, which prevents the component from being lost and facilitates reinserting the component into the circuit.

The various features and advantages of this invention will become apparent to those skilled in the art from the following detailed description of the preferred embodiment. The drawings that accompany the detailed description can be briefly described as follows.

DETAILED DESCRIPTION OF A PREFERRED EMBODIMENT

Figure 1:
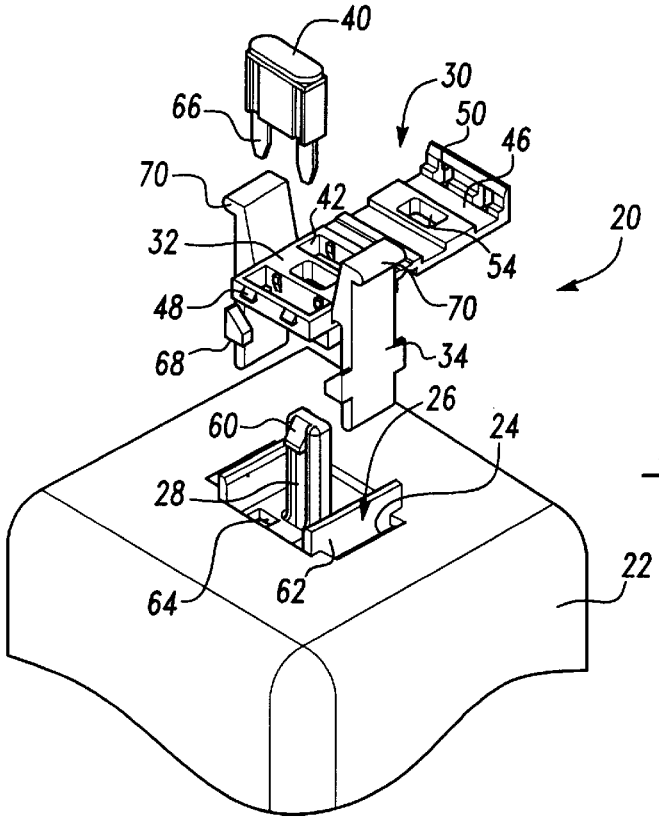
FIG. 1 is an exploded, perspective illustration of an assembly designed according to this invention.

FIG. 1 illustrates a component retainer device assembly 20 that is useful for handling an electrical component and maintaining it in a selected orientation and position relative to a circuit. A housing 22, which is adapted to house at least part of the circuitry, includes an opening 24 through an exterior surface of the housing. A mounting member 26 is supported on the housing 22 at the opening 24. A guide member 28 extends generally away from the housing.

Figure 2:
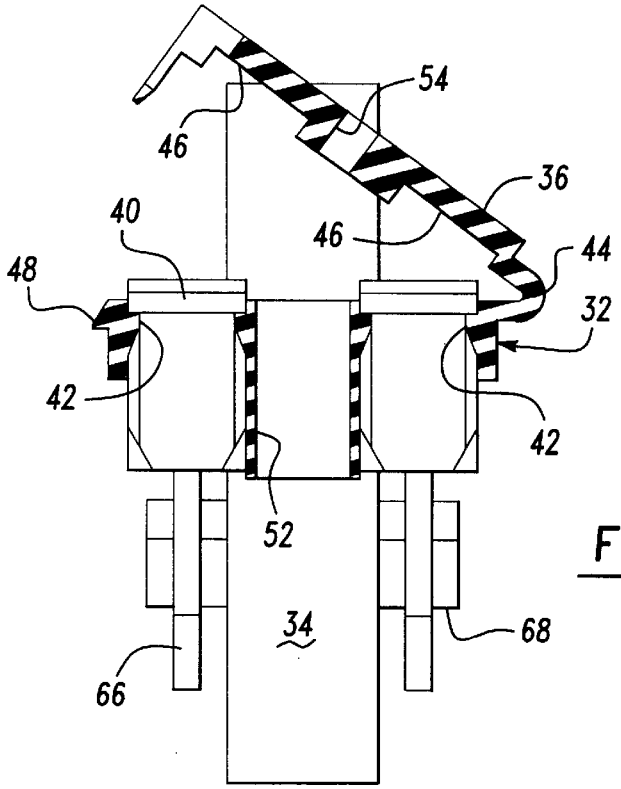
FIG. 2 is a cross sectional illustration of the component retainer portion of the embodiment of FIG. 1.

A component receiver 30 includes a receiver body portion 32, a set of support arms 34 and a cover 36. The illustrated component receiver is adapted to support and retain a fuse 40 in position relative to a circuit. As best seen in FIG. 2, the receiver body 32 includes a pair of slots 42, each of which are adapted to support a separate fuse. Once the fuses 40 are placed in position within the slots 42, the cover 36 is closed by manipulating it about the pivot axis and a living hinge 44 that connects the cover to the receiver body 32. In the preferred embodiment, the cover 36 includes two recessed portions 46 that nestingly receive an outer edge of each fuse 40. A set of tabs 48 interact with engagement surfaces 50 to maintain the cover in a closed position.

Figure 3:
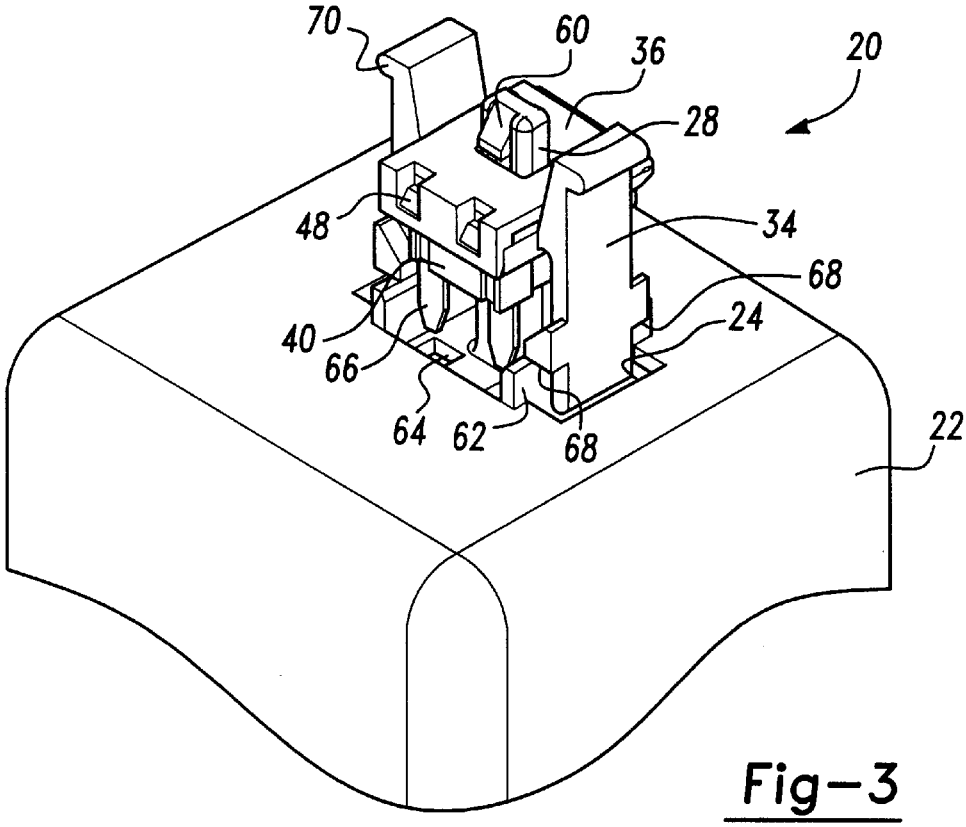
FIG. 3 shows the embodiment of FIG. 1 in an assembled first position.
Figure 4:
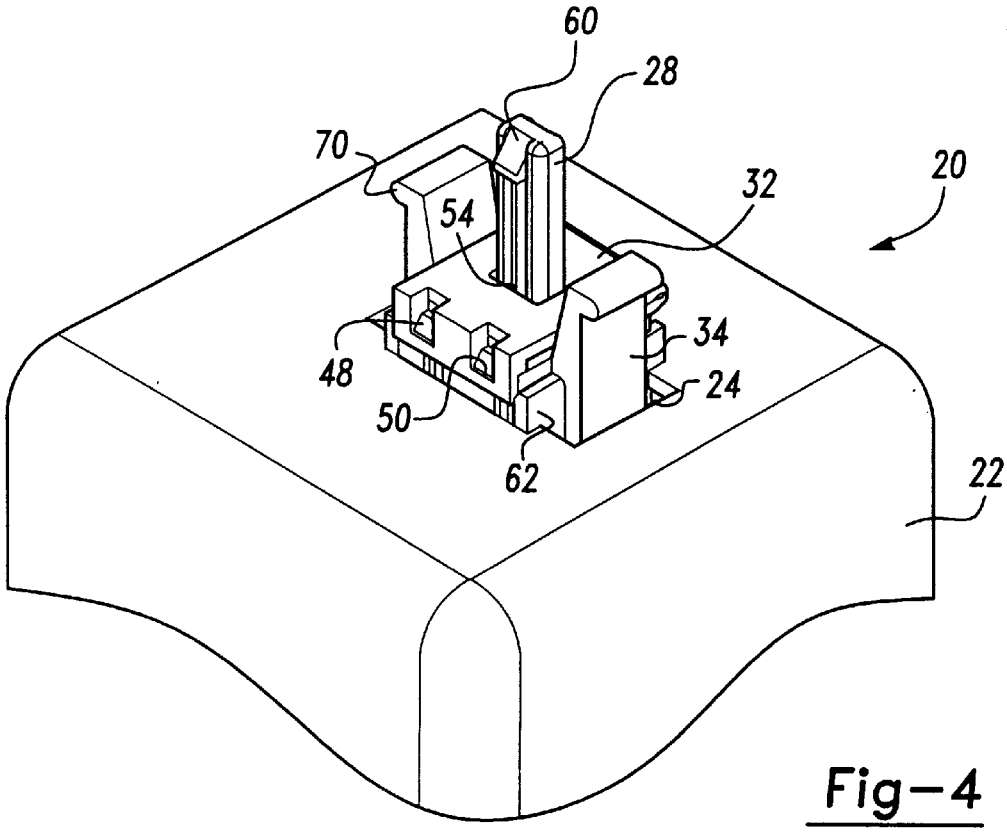
FIG. 4 shows the embodiment of FIG. 3 in a second position.

The receiver body portion 32 includes a central slot 52 that is aligned with a central slot 54 in the cover 36 when the cover is placed in a closed position. The receiver 30 can then be placed over the guide member 28 so that the guide member extends through the central slots 52 and 54 as shown in FIGS. 3 and 4. The dimensions of the central slots 52 and 54 and the exterior surface on the guide member 28 ensure that the receiver 30 is maintained in a specific alignment relative to the housing 22.

Importantly, the guide member 28 includes a stop member 60, which preferably comprises a tab. The stop member 60 preferably includes a ramped surface that allows the receiver 30 to be placed over the guide member 28. Once the receiver body portion 32 and the cover 36 pass beyond the stop member 60, the stop member prevents the receiver 30 from being removed from the guide member under normal circumstances. Since the various pieces of the device 20 are made of plastic, it is possible to later remove the receiver from the guide member as necessary, however, for practical purposes the retainer is maintained on the guide member 28 by the stop member 60.

The mounting member 26 includes a pair of wing portions 62 along which inner surfaces of the support arms 34 are received. The mounting member also includes slots 64 that are positioned to receive prongs 66 on the fuses 40 so that the fuses can be inserted into a connection terminal in the circuit (not illustrated). The interaction between the guide member 28 and the central slots 52 and 54 and the interaction between the winged portions 62 and the support arms 34 ensures that the component receiver will move in a specific direction and maintain a preferred alignment relative to the circuit and the housing 22. Perpendicular travel and alignment of the fuses relative to the housing is most preferred.

The receiver 30 can be moved between a first position shown in FIG. 4 where the component (in this instance the fuses 40) engage a connection terminal on the circuit and a second position shown in FIG. 3 where the component is disconnected from the circuit. The support arms 34 include stop members 68 that are biased positioned to automatically engage the winged portions 62 on the mounting member 26 when the receiver 30 is place d in the second position. The stop members 68 ensure that the component will not be inadvertently or accidentally connected with the circuit but will be maintained in the second position. In the preferred embodiment, the support arms 34 are connected with the receiver body 32 so that a technician can manipulate an extension 70 on the end of each support arm 34. By moving the extensions 70 toward each other the stop members 68 are moved out of engagement with the winged portions 62 and the entire receiver 30 can be moved into the first position so that the component can be connected to the terminal in the circuit.

This invention provides several important advantages. First, an electrical component is maintained in a disconnected positioned without being completely separated from the housing. Further, the component cannot be moved back into a connected position without specifically operating the retainer device. The arrangement keeps the component in a specific alignment with the connection terminals of the circuit. Maintaining proper alignment is important to ensure that the component is properly connected to the connection terminal.

The description of the preferred embodiment given above is exemplary rather than limiting in nature. Variations and modifications to the disclosed embodiment may become apparent to those skilled in the art that do not necessarily depart from the purview and spirit and of this invention. The scope of legal protection given to this invention can only be determined by studying the following claims.

We claim:

1. A device for positioning a component relative to a circuit, comprising:

a housing adapted to house at least a portion of the circuit including an input connection, said housing having an exterior surface with an opening in the vicinity of said input connection;

a guide member supported on said housing such that said guide member extends generally away from said exterior surface of said housing;

a component receiver adapted to receive and support the component, said component receiver being movably supported on said guide member for movement between a first position where the component engages said input connection and a second position where the component is spaced from said input connection; and a mounting member received at least partially within the opening of said housing, said mounting member supporting said guide member and having a portion that interacts with said component receiver to facilitate said component receiver being moved between said first and second positions, wherein the component at least partially passes through the opening of said housing as said component receiver is moved between said first and second positions and wherein said housing and said component receiver interact to selectively maintain said component receiver in said second position and said guide member and said component receiver interact to maintain said component receiver in relation to said housing.

2. The device of claim 1, wherein said component receiver includes a receiver body portion having an opening therethrough that is adapted to receive the component and a cover portion that is selectively moveable between a closed position and an open position, said cover portion maintaining said component within the opening of said receiver body portion when in the closed position.

3. The device of claim 2, wherein said cover portion is hingedly supported relative to said receiver body portion and maintained in said closed position by a tab on one of said receiver body portion and said cover portion and a cooperating engagement surface on the other of said cover portion and said body portion.

4. The device of claim 2, wherein said receiver body portion includes a slot that receives said guide member such that said component receiver is slidable along a longitudinal axis of said guide member between said first and second positions and wherein said guide member includes a stop member that limits movement of said component receiver such that said component receiver is maintained within a selected proximity of said housing.

5. The device of claim 4, wherein said stop member comprises a tab that allows said receiver body portion to be placed onto said guide member but prevents said receiver body portion from being removed from said guide member such that said tab limits movement of said component receiver in a direction away from said housing.

6. The device of claim 1, wherein said component receiver includes a receiver body portion having an opening therethrough that is adapted to receive the component, and a stop member that engages said housing to maintain said component receiver in said second position.

7. The device of claim 6, wherein said stop member is biased into engagement with said housing when said component receiver is in said second position.

8. The device of claim 1, wherein said component receiver further includes a receiver body portion and two support arms on opposite sides of said receiver body portion, each support arm including a stop member, and wherein said support arms are manipulatable such that each stop member can be selectively moved out of engagement with said housing, said component receiver being selectively moveable out of said second position when each stop member is moved out of engagement with said housing.

9. The device of claim 8, wherein each support arm is generally flexible and capable of moving each stop member out of engagement with said housing.

10. The device of claim 8, wherein each support arm is pivotally supported relative to said receiver body portion such that each support arm is capable of pivoting relative to said receiver body portion to selectively move each stop member out of engagement with said housing.

11. A device for supporting a circuit component in a selected position relative to a circuit, comprising:

a housing adapted to house at least a portion of the circuit including a connection terminal;

a guide member supported on said housing such that said guide member extends generally away from said housing and the circuit; and a component receiver including a receiver body portion that is adapted to receiver and support the component;

a support that supports said receiver body portion in a first position relative to said housing which corresponds to an engaged position where the component engages the connection terminal and a second position relative to said housing which corresponds to a removed position where the component is spaced from the connection terminal, said component receiver being selectively moveable between said first and second positions;

wherein said guide member is a generally longitudinal member and includes a stop member near an end of said guide member capable of engaging a portion of said receiver body portion, thereby maintaining said component receiver within a preselected distance from said housing.

12. The device of claim 11, wherein said housing includes an opening near said connection terminal and wherein said support is received within and at least partially passes through a portion of the opening of said housing as said component receiver is moved between said first and second positions,. and wherein said support includes a stop member that interacts with said housing to maintain said component receiver in said second position.

13. The device of claim 11, wherein said receiver body portion includes a slot capable of receiving said guide member, said stop member engaging said receiver body portion adjacent said slot when said component receiver is moved the preselected distance away from said housing.

14. The device of claim 11, wherein said receiver further includes a cover portion that is moveable relative to said receiver body portion between a closed position and an open position, said cover portion maintaining the component supported on said receiver body portion when in the closed position, and wherein one of said receiver body portion and said cover portion includes a tab member and the other one of said receiver body portion and said cover portion includes a corresponding engagement surface, said tab member and said corresponding engagement surface interact to selectively maintain said cover portion in the closed position.

15. The device of claim 11, further comprising a mounting member supported on said housing, and wherein said support engages a portion of said mounting member to selectively maintain said component receiver in said first and second positions.

16. The device of claim 11, wherein said support comprises two support arms on opposite sides of said receiver body portion, each support arm having a stop member that engages said housing to maintain said component receiver in said second position, and wherein each stop member is biased into engagement with said housing when said component receiver is moved into said second position.

17. The device of claim 16, wherein each support arm is moveable such that each stop member is capable of being selectively disengaged from said housing.

18. The device of claim 16, wherein each support arm is moveable relative to said receiver body portion to disengage each stop member from said housing.

* * * * *